US005137470A

United States Patent [19]

Doles

[11] Patent Number: 5,137,470

[45] Date of Patent: Aug. 11, 1992

[54] CONNECTOR FOR COAXIAL CABLE HAVING A HELICALLY CORRUGATED INNER CONDUCTOR

[75] Inventor: Connie S. Doles, LaGrange Park, Ill.

[73] Assignee: Andrew Corporation, Orland Park, Ill.

[21] Appl. No.: 710,017

[22] Filed: Jun. 4, 1991

[51] Int. Cl.[5] ..... H01R 17/04

[52] U.S. Cl. ..... 439/578; 439/583

[58] Field of Search ..... 439/578-585, 439/675, 322, 98, 99, 426, 427, 805

[56] References Cited

U.S. PATENT DOCUMENTS 3,199,061 8/1965 Johnson et al. ..... 439/429
3,291,895 12/1966 Van Dyke ..... 439/578
3,320,575 5/1967 Brown et al. ..... 439/584
3,678,446 7/1972 Siebelist ..... 439/583
4,046,451 9/1977 Juds et al. ..... 439/583

*Primary Examiner*—David L. Pirlot
*Attorney, Agent, or Firm*—Arnold, White & Durkee

[57] ABSTRACT

A connector assembly has a cylindrical inner contact member with a threaded outer surface to match the helical corrugations of the inner conductor of the coaxial cable so that the inner contact member can be threaded into the helically corrugated inner conductor. A flaring ring and a clamping member have opposed bevelled surfaces for engaging the respective inner and outer surfaces of the outer conductor of the cable. A body member draws and holds the bevelled surface of the flaring ring and the clamping member together against opposite surfaces of the outer conductor of the cable.

8 Claims, 3 Drawing Sheets

CONNECTOR FOR COAXIAL CABLE HAVING A HELICALLY CORRUGATED INNER CONDUCTOR

FIELD OF THE INVENTION

The present invention relates generally to connectors for coaxial cables, and, more particularly, to connectors for coaxial cables having helically corrugated inner conductors.

BACKGROUND OF THE INVENTION

Connectors for coaxial cable having corrugated conductors are generally used throughout the semi-flexible coaxial cable industry. For example, Juds et al. U.S. Pat. No. 4,046,451 describes a connector for coaxial cables having annularly corrugated outer conductors and plain cylindrical inner conductors. A connector for a coaxial cable having a helically corrugated outer conductor and a plain cylindrical inner conductor is described in Johnson et al. U.S. Pat. No. 3,199,061.

SUMMARY OF THE INVENTION

It is a primary object of the present invention to provide an improved connector for coaxial cables having helically corrugated inner conductors, which can be easily and quickly installed, or removed and reinstalled, particularly under field conditions.

It is another object of this invention to provide such an improved connector which can be installed and removed without the use of any special tools.

A further object of this invention is to provide such an improved connector which has only a small number of parts.

Still another object of this invention is to provide such an improved connector which can be efficiently and economically manufactured.

A still further object of this invention is to provide an improved connector providing a superior junction between the helically corrugated inner conductor and the connector.

Other objects and advantages of the invention will be apparent from the following detailed description and the accompanying drawings.

In accordance with the present invention, the foregoing objectives are realized by providing a connector assembly having a cylindrical inner contact member with a threaded outer surface to match the helical corrugations of the inner conductor of the coaxial cable so that the inner contact member can be threaded into the helically corrugated inner conductor; a flaring ring and a clamping member having opposed bevelled surfaces for engaging the respective inner and outer surfaces of the outer conductor of the cable; and a body member having means for drawing and holding the bevelled surfaces of said flaring ring and said clamping member together against opposite surfaces of the outer conductor of the cable.

DESCRIPTION OF THE PREFERRED EMBODIMENT

Figure 1:
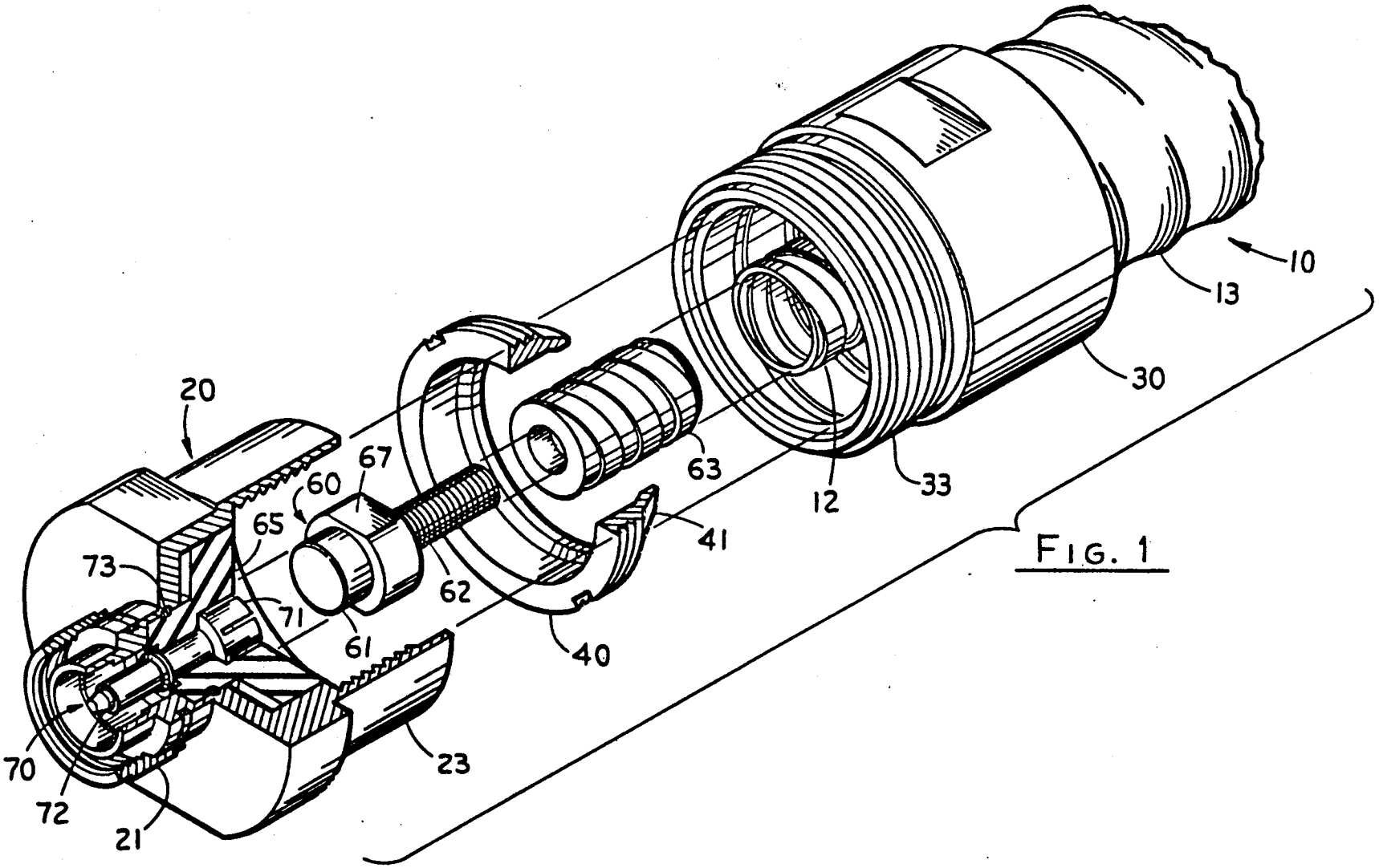
FIG. 1 is a perspective view of a connector embodying the present invention.
Figure 2:
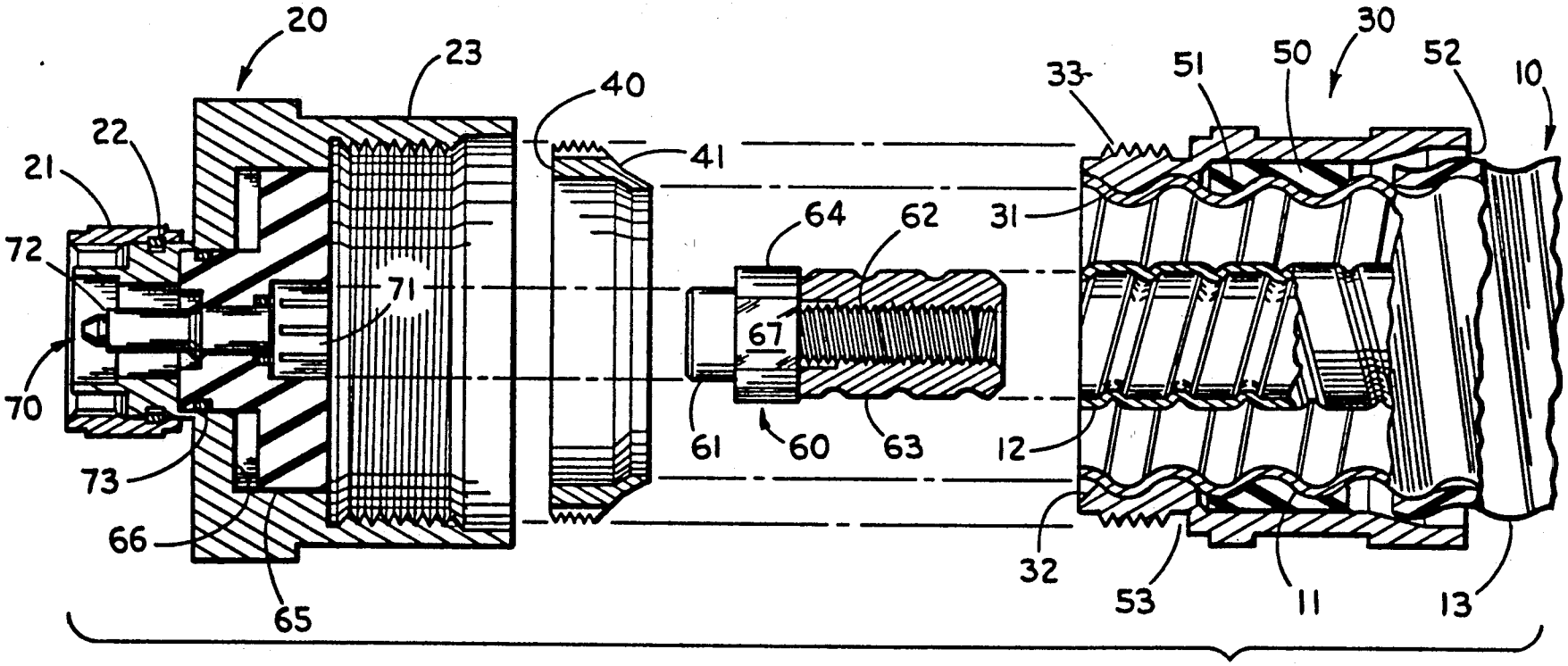
FIG. 2 is a longitudinal sectional view of the connector shown in FIG. 1 with only two of the parts attached to the coaxial cable.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, there is shown a connector assembly for a coaxial cable 10 having a helically corrugated outer conductor 11 concentrically spaced from a helically corrugated inner conductor 12 by a dielectric spacer (not shown). As is well known to those familiar with this art, a helically corrugated conductor is distinguished from an annularly corrugated conductor in that the helical corrugations form a continuous pattern of corrugation crests and roots along the length of the cable such that each crest is opposite a root along the circumference of the conductor. Consequently, any transverse cross-section taken through the conductor perpendicular to its axis is radially asymmetrical, which is not true of annularly corrugated conductors.

To prepare the cable 10 for attachment of the connector assembly, the end of the cable is cut along a plane extending perpendicular to the axis of the cable and through the apex of one of the crests of the corrugated outer conductor 11. This exposes the clean and somewhat flared internal surface of the outer conductor 11. Any burrs or rough edges on the cut ends of the metal conductors 11 and 12 are preferably removed to avoid interference with the connector. The outer surface of the outer conductor 11 is normally covered with a plastic jacket 13 which is trimmed away from the end of the outer conductor 11 along a sufficient length to accommodate the connector assembly. 15 A stepped cylindrical body member 20 extends around the cut end of the coaxial cable 10. The reduced-diameter end portion of the body member 20 carries a conventional coupling nut 21. This coupling nut 21 is secured to the body member 20 by a spring retaining ring 22 which holds the nut 21 captive on the body member 20 while permitting free rotation of the nut 21 on the member 20. As will be apparent from the ensuing description, this coupling nut 21 serves as a part of the electrical connection to the outer conductor 11 of the cable 10, and is insulated from the inner conductor 12.

A clamping member 30 has a threaded inner surface 31 to match the helical corrugations of the outer conductor 11. Thus, the member 30 can be threaded onto the outer conductor 11 until at least a major portion of a conically bevelled surface 32 on the end of the clamping member 30 overlaps the outer conductor 11. The conically bevelled surface 32 slopes inwardly toward the threaded inner surface 31 of the clamping member 30.

Figure 3:
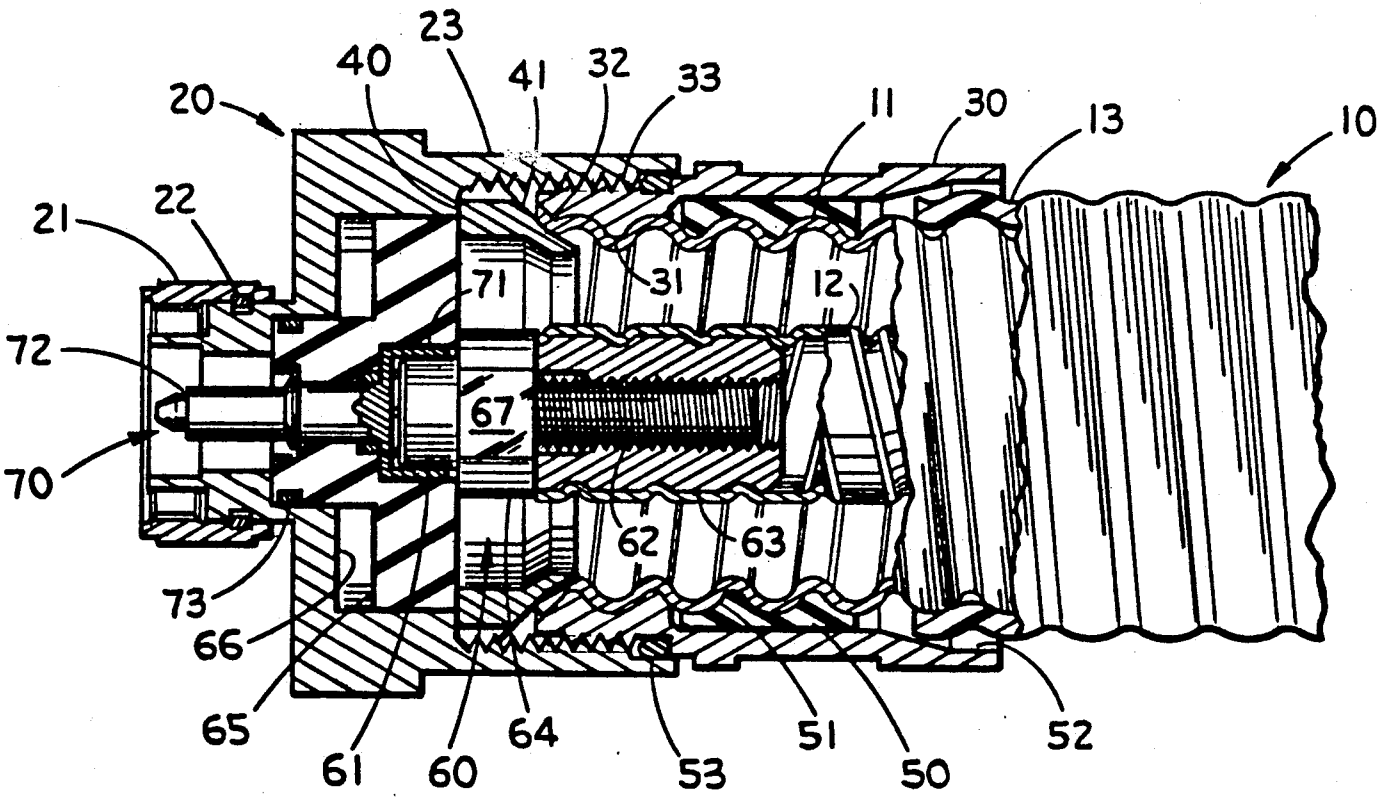
FIG. 3 is a longitudinal sectional view of the connector shown in FIG. 1 with the connector fully assembled.

To make electrical connection with the inner surface of the outer conductor 11 of the coaxial cable 10, a flaring ring 40 is threaded into the body member 20. The forward end of the ring 40 forms a conically bevelled surface 41 which matches the bevelled surface 32 on the clamping member 30. The inside diameter of the forward end of the flaring ring 40 is at least as small as the minor inside diameter of the outer conductor 11, so that the bevelled surface 41 will engage the inner surface of the end portion of the outer conductor 11 around the entire circumference of the cut end. As illustrated in FIG. 3, the bevelled surface 41 acts to flare the end of the outer conductor 11 outwardly as the flaring ring is forced into the outer conductor during assembly of the connector, i.e., as the clamping member 30 and the body member 20 are threaded together. Consequently, the connector is self-flaring, and there is no need to manually flare the end of the outer conductor with a pliers or other tool. In the illustrative embodiment, the surface 41 is bevelled at an angle of about 30° at the forward end and about 45° at the rear end, so that the initial flaring action is more gradual than the final flaring action. The optimum angle of the bevelled surface 41 for any given application is dependent on the size of the coaxial cable 10.

Because the inside diameter of the forward end of the flaring ring 40 is smaller than the minor inside diameter of the outer conductor 11 of the coaxial cable, the flaring ring tends to cause a slight increase in the VSWR of the transmission line. To minimize this effect caused by the forward end of the flaring ring, the inside diameter of the rear portion of the flaring ring is slightly larger than the minor inside diameter of the outer conductor 11. Moreover, the transition between the two different inside diameters of the flaring ring 40 is located close to the forward end of the flaring ring.

For the purpose of drawing the flaring ring 40 and the clamping member 30 firmly against opposite sides of the flared end portion of the outer conductor 11, the body member 20 and the clamping member 30 include respective telescoping sleeve portions 23 and 33 with cooperating threaded surfaces. Thus, when the body member 20 is threaded onto the clamping member 30, the two members are advanced toward each other in the axial direction so as to draw the flaring ring 40 and the clamping member 30 into electrically conductive engagement with the outer conductor 11. When the flared end portion of the outer conductor 11 is clamped between the bevelled surface 41 of the flaring ring 40 and the bevelled surface 32 of the clamping member 30, it is also at least partially flattened to conform with the planar clamping surfaces. To disengage the connector assembly, the body member 20 is simply threaded off the clamping member 30 to retract the two members away from each other until their threaded surfaces are disengaged.

To provide a moisture barrier between the inner surface of the clamping member 30 and the outer surface of the outer conductor 11, a gasket 50 is positioned within the cylindrical portion of the clamping member behind the threaded inner surface 31. The gasket 50 has a threaded inner surface 51 to match the helical corrugations of the outer conductor 11. When the clamping member 30 is threaded onto the outer conductor 11, the gasket 50 compresses slightly so that the gasket bears firmly against both the outer surface of the conductor 11 and the inner surface of the clamping member 30. The adjacent end portion of the clamping member 30 forms a slightly enlarged recess 52 so that it can fit over the end of the polymeric jacket 13 on the coaxial cable 10. A moisture barrier is also provided by a O-ring 53 positioned between the opposed surfaces of the sleeve portions 23 and 33 of the members 20 and 30, respectively.

Electrical contact with the inner conductor 12 of the cable 10 is effected by an inner connector element 60 forming a threaded outer surface to make electrical contact with the inside surface of the hollow inner conductor 12. The connector element 60 includes a head 61 and a threaded shank 62 which threads into a conductive sleeve 63. It is the outer surface of the sleeve 63 which is threaded to mesh with the inner surface of the corrugated inner conductor 12. The base of the head 61 forms an enlarged collar 64 which limits the penetration of the sleeve 63 into the inner conductor 12 by engaging the cut end of the inner conductor.

An insulating sleeve 65 centers the inner connector element 60 within the main body member 20 of the connector assembly and electrically isolates the inner and outer connector elements from each other. It will be noted that the interior of the body member 20 includes a stepped recess 66 for receiving the insulator 65.

To ensure intimate contact between the inside surface of the inner conductor 12 and the outside surface of the sleeve 63, at least a portion of the outside diameter of the sleeve 63 is at least as great as the inside diameter of the mating portion of the inner conductor 12. For example, the minor outside diameter of the sleeve 63 is slightly greater than the minor inside diameter of the inner conductor 12. Then when the sleeve 63 is threaded into the corrugated conductor 12, the minor outside diameter of the sleeve 63 presses against the minor inside diameter of the conductor 12. This causes a slight disruption of the conductor 12 at its minor diameter, and produces a tight press-fit between the sleeve 63 and the conductor 12. Such a press-fit ensures reliable electrical and mechanical contact between the inner connector element 60 and the conductor 12 during temperature cycling and vibration, for example.

To facilitate threading of the connector element 60 into the corrugated inner conductor 12, flats 67 are preferably formed on the collar 64 of the head 61 of the element 60. These flats 67 permit the collar 64 to be easily engaged by a wrench for rotating the element 60 and thereby threading it into the inner conductor 12, even when the threaded surface of the sleeve 63 and the conductor 12 are in tight engagement with each other.

The small portion of the head 61 of the connector 60 is electrically connected to a pin 70 by means of multiple spring fingers 71 formed as integral parts of the base of the pin 70. These spring fingers 71 fit over and snugly against the outer surface of the head 61. The head 72 of the pin 70 forms the male portion of a conventional connector.

As can be seen most clearly in FIG. 3, the pin 70 is held in place within the connector assembly by the insulating sleeve 65 whose inner surface is complementary with the outer surface of the pin 70. An O-ring 73 forms an air seal between the sleeve 65 and the body member 20.

As can be seen from the foregoing detailed description of the illustrative embodiments of the invention, the improved connector assembly is easy to install or reinstall even under adverse field conditions. The connector assembly has a minimum number of parts to minimize the possibility of loss of parts during installation. Moreover, the connector assembly is self-flaring and does not require any preliminary manual flaring operations prior to the installation of the connector assembly. The connector provides positive electrical contact, particularly with the helically corrugated outer conductor, to ensure reliable electrical performance. Furthermore, the connector assembly can be efficiently and economically manufactured.

I claim:

1. A connector assembly for a coaxial cable having an outer conductor and a helically corrugated inner conductor, the connector assembly comprising:

a cylindrical inner contact member having a threaded outer surface to match the helical corrugations of the inner conductor of the coaxial cable so that said contact member can be threaded into the helically corrugated inner conductor, the outside diameter of at least a portion of said inner contact member being slightly greater than the inside diameter of the mating portion of said inner conductor so that the threading of said inner contact member into said inner conductor forms a tight press-fit between said inner contact member and said inner conductor;

a flaring ring and a clamping member having opposed bevelled surfaces for engaging the respective inner and outer surfaces of the outer conductor of the cable; and a body member having means for drawing and holding the bevelled surfaces of said flaring ring and said clamping member together against opposite surfaces of the outer conductor of the cable.

2. The connector assembly of claim 1 wherein said inner contact member has a head portion which forms diametrically opposed flat surfaces to facilitate the threading of said contact member into said inner conductor.

3. The connector assembly of claim 1 which includes and inner conductor and a dielectric spacer which encircles the inner conductor so as to center it respect to the outer conductor.

4. The connector assembly of claim 1 wherein the clamping and body members include integral telescoping sleeves with cooperating threaded surfaces which form said drawing and holding means.

5. The connector assembly of claim 1 wherein said outer conductor has a major inside diameter at the crests of the corrugations therein and a minor inside diameter at the roots of the corrugations, and said inside diameter of said flaring ring is smaller than the minor inside diameter of the helically corrugated outer conductor.

6. The connector assembly of claim 1 wherein said outer conductor has a major inside diameter at the crests of the corrugations therein and a minor inside diameter at the roots of the corrugations, and the inside diameter of the bevelled surface of said flaring ring is at least as small as the minor inside diameter of said outer conductor, and the inside diameter of a portion of the flaring ring is larger than the minor inside diameter of said outer conductor.

7. The connector assembly of claim 1 wherein the bevelled surface of said flaring ring is bevelled at a shallower angle at the end of the beveled surface which initially engages said outer conductor than along the remainder of the beveled surface.

8. A connector assembly for a coaxial cable having an outer conductor and a helically corrugated inner conductor, the connector assembly comprising:

a cylindrical inner contact member having a threaded outer surface to match the helical corrugations of the inner conductor of the coaxial cable so that said contact member can be threaded into the helically corrugated inner conductor, the outside diameter of at least a portion of said inner contact member being slightly greater than the inside diameter of the mating portion of said inner conductor so that the threading of said inner contact member into said inner conductor forms a tight press-fit between said inner contact member and said inner conductor;

a flaring ring and a clamping member having opposed bevelled surfaces for engaging the respective inner and outer surfaces of the outer conductor of the cable, the end of said flaring ring opposite the bevelled surface of said ring being threaded into said body member; and a body member having means for drawing and holding the bevelled surfaces of said flaring ring and said clamping member together against opposite surfaces of the outer conductor of the cable.

* * * * *